US010743600B2

(12) United States Patent
Cleveland et al.

(10) Patent No.: US 10,743,600 B2
(45) Date of Patent: Aug. 18, 2020

(54) PRESSURE ATTENUATING HELMET

(71) Applicants: Joshua Ryan Cleveland, River Falls, WI (US); Gina Rebecca Cleveland, River Falls, WI (US)

(72) Inventors: Joshua Ryan Cleveland, River Falls, WI (US); Gina Rebecca Cleveland, River Falls, WI (US)

( * ) Notice: Subject to any disclaimer, the term of this patent is extended or adjusted under 35 U.S.C. 154(b) by 171 days.

(21) Appl. No.: 15/860,593

(22) Filed: Jan. 2, 2018

(65) Prior Publication Data

US 2018/0192728 A1 Jul. 12, 2018

Related U.S. Application Data

(60) Provisional application No. 62/498,749, filed on Feb. 6, 2017, provisional application No. 62/498,750, filed on Jan. 6, 2017.

(51) Int. Cl.

| | |
|---|---|
| ***A42B 3/06*** | (2006.01) |
| ***A63B 71/10*** | (2006.01) |
| ***A42B 3/12*** | (2006.01) |
| ***A42B 3/32*** | (2006.01) |

(52) U.S. Cl.

CPC ..... *A42B 3/064* (2013.01); *A42B 3/127* (2013.01); *A42B 3/128* (2013.01); *A42B 3/32* (2013.01); *A63B 71/10* (2013.01)

(58) Field of Classification Search

CPC ..... A42B 3/046; A42B 3/127; A42B 3/128
USPC ..... 2/412
See application file for complete search history.

(56) References Cited

U.S. PATENT DOCUMENTS

| | | | | |
|---|---|---|---|---|
| 3,186,004 | A | 6/1965 | Carlini | |
| 3,192,536 | A | 7/1965 | Benner | |
| 3,609,764 | A | 10/1971 | Morgan | |
| 3,668,704 | A | 6/1972 | Conroy et al. | |
| 3,882,547 | A | 5/1975 | Morgan | |
| 4,023,209 | A * | 5/1977 | Frieder, Jr. ..... | A42B 3/166 2/6.6 |
| 4,287,613 | A | 9/1981 | Schulz | |
| 4,692,947 | A | 9/1987 | Black et al. | |
| 6,360,376 | B1 * | 3/2002 | Carrington ..... | A42B 3/00 2/411 |
| D718,002 | S | 11/2014 | Littrell | |
| D764,116 | S | 8/2016 | Collette et al. | |
| D766,517 | S | 9/2016 | Collette et al. | |

(Continued)

*Primary Examiner* — Timothy K Trieu
(74) *Attorney, Agent, or Firm* — Lamon Patent Services; Cynthia S. Lamon

(57) ABSTRACT

A pressure attenuating helmet is provided including separate plates having a plate thickness, an outer surface, under surface, and adjacent edges. The plates joined along the adjacent edges to the other ones of the plurality of plates, forming a helmet shell. Perforated flanges formed along the under surface at the adjacent edges of the plates, the flanges formed inwardly along a line from the adjacent edge of each of the plates extending in the direction of the thickness of the plates. Perforation in the flanges spaced equidistantly in an array along a long direction of the flanges, enabled to accept sutures and aligned flange-to-flange. A network of elastomer splines shaped and positioned to separate the adjacent plates both along the adjacent edges and the perforated flanges. Sutures through the perforations securing the plates together along the adjacent edges and foam cushions are provided between the plates and a wearers head.

5 Claims, 11 Drawing Sheets

(56) References Cited

U.S. PATENT DOCUMENTS

| | | | | |
|---|---|---|---|---|
| 9,498,014 | B2 * | 11/2016 | Princip | A42B 3/064 |
| D778,504 | S | 2/2017 | Collette et al. | |
| 10,098,406 | B2 | 10/2018 | Erb et al. | |
| 10,172,408 | B1 | 1/2019 | Kelly | |
| 2012/0151663 | A1 * | 6/2012 | Rumbaugh | A42B 3/065 2/411 |
| 2015/0223546 | A1 * | 8/2015 | Cohen | A42B 3/063 2/412 |
| 2016/0120255 | A1 * | 5/2016 | Alexander | A42B 3/063 2/412 |

* cited by examiner

PRESSURE ATTENUATING HELMET

CROSS-REFERENCE TO RELATED APPLICATIONS

The present application claims the benefit of priority under 35 U.S.C. 119 from U.S. Provisional Patent Applications No. 62/498,750 filed Feb. 6, 2017 and No. 62/498,750 filed Jan. 6, 2017; the disclosures of which are hereby incorporated by reference in their entirety for all purposes.

BACKGROUND OF THE INVENTION

1. Field of the Invention

The present invention relates to a protective helmet, such as a helmet for protecting a user's head during various activities that require head protection. Sporting activities including football, motorcycle riding, bicycle riding, any off road sport, virtually any activity where protecting one's head is an issue.

2. Description of Related Art

In amateur and professional sports, participants engage in forceful bodily contact with other participants and contact with fixed surfaces or structures. Participants commonly utilize clothing and protective gear designed for the type of sport. In football protective gear includes but is not limited to helmets, facemasks, mouth guards, pads, gloves and shoes.

In the field of protective headgear or helmets for contact sports, the nature and frequency of the impacts the helmets incur, affect the appropriate design of the gear. For example, in football, the helmet is likely to come in contact with blunt objects such as other helmets or the turf, while a hockey helmet may be impacted by a hockey stick or a flying puck. Football helmets are likely to incur hundreds or thousands of "hits" making it a multiple-use or reusable device, while in auto racing the driver's helmet is expected to take a greater impact which might preclude its safe reuse. The direction of impact to the surface of the helmet requires consideration in the design, for example a direct force against the helmet or rotational forces may act in a crushing manner, while a glancing blow may cause the helmet to rotate sharply way from the applied force. If these forces are not properly distributed and absorbed by a helmet internal strain may occur causing brain damage and even death.

As medical science progresses increasing concerns have arisen over short term and long term effects of repeated head injuries players incur resulting in concussions and related traumatic brain injuries. Therefore new styles of helmets are clearly needed that are designed to withstand frequent multiple impact forces where applied forces are dissipated or attenuated to lessen the transfer of forces from the shell of the helmet to the head of the wearer to reduce the potential for concussions and traumatic brain injuries.

BRIEF SUMMARY OF THE INVENTION

A first embodiment of the present invention provides a pressure attenuating helmet including a plurality of separate plates having a plate thickness, an outer surface, under surface, and adjacent edges to other ones of the plurality of plates. The plates are enabled to be joined along the adjacent edges to the other ones of the plurality of plates, forming a helmet shell.

In this embodiment perforated flanges may be formed along the under surface at the adjacent edges of the plurality of separate plates, the flanges formed inwardly along a line spaced at a first dimension from the adjacent edge of each of the plates extending in the direction of the thickness of the plates, the perforations spaced equidistantly in an array along a long direction of the flanges, enabled to accept sutures and aligned flange-to-flange.

A network of elastomer splines may be shaped and positioned to separate adjacent plates both along the adjacent edges and the perforated flanges. Sutures may pass through the matching perforations in the perforated flanges along the adjacent edges of the plates, and through the elastomer splines, the sutures securing the plates together along the adjacent edges.

In another embodiment, the plurality of plates are shaped and oriented in the helmet to any one or more of parietal bones of the human cranium, occipital bone, frontal bone, zygomatic arch, temporal bones and atlas vertebra of the neck. The sutures may also be made of energy dissipating stress fibers and/or an aromatic polyamide such as KEVLAR® aramid fiber.

In one embodiment, at least one foam layer is formed to the undersurface of each plate. A third foam layer may be formed to engage a user's head, and a second foam layer may be formed between the first and third foam layers. The foam layers may be manufactured with a highest durometer rating at the first foam layer, the durometer rating descending for the second layer and the softest or lowest durometer rating at the third foam layer.

Another embodiment includes that the perforations are equidistantly spaced at between 0.5 cm to 10 cm and each perforation has a diameter between 0.10 cm to 2.5 cm. Additionally, in an embodiment cavities may be formed in or through the foam layers, edges of the cavities hermetically sealed to the plates to form cavities with a volume of air. In this embodiment, the foam layers are adhered to each other forming a single foam insert which may be removably attached to the plates.

DETAILED DESCRIPTION OF THE INVENTION

Figure 1:
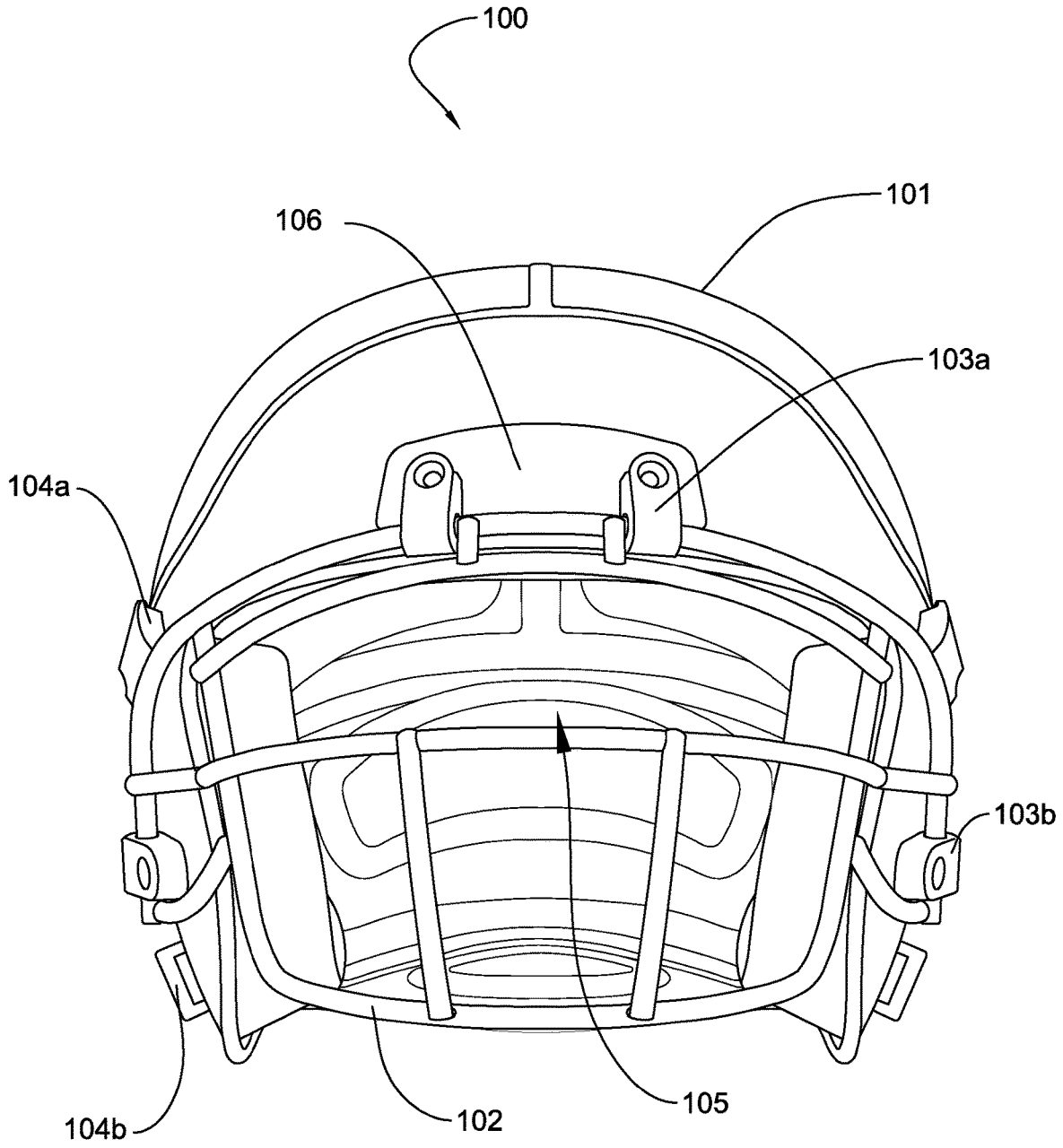
FIG. 1 is a front view of a helmet assembly.

FIG. 1 shows one embodiment of a pressure attenuating helmet. A football helmet is shown, but the teaching may apply to other types of helmets used during other activities, as well. Other embodiments of the invention may include helmets for other sports such as hockey, baseball, lacrosse, bicycling, skating, skiing, motor racing, etc. where the wearer may be subjected to forceful impacts.

FIG. 1 provides a front view of a safety helmet 100 consisting of an outer segmented shell 101 with a cage-like face guard 102 affixed to the helmet shell over an opening 105 allowing for a wide field of vision while protecting the face. Guard 102 is secured to shell 101 with guard mounts 103*a* at the brow and mounts 103*b* at the cheeks. Chin strap buckles 104*a* may be mounted at each temple and buckles 104*b* at the jawline on each side. Snap buckles allow for adjustment of chin straps (not shown) for proper fit and facilitates easy donning and shedding of the helmet. A chin strap is not shown in this figure. Guard mounts 103*a* may be secured through name plate 106. Foam cushions inside the helmet provide padding between shell 101 and the skull of the wearer. These cushions are identified and described more fully later in this specification.

Accessory components described, such as face guard 102, guard mounts 103*a* and 103*b*, snap buckles 104*a* and 104*b*, and chin straps are available from other manufacturers and may be used in the manufacture of helmet assembly 100. Other embodiments of this invention may make use of other accessory components specifically suited to address the needs of different sports and activities. Helmet assembly 100 may be produced in a variety of sizes to fit the heads of youths or adults when equipped with cushions described in later figures.

Figure 2:
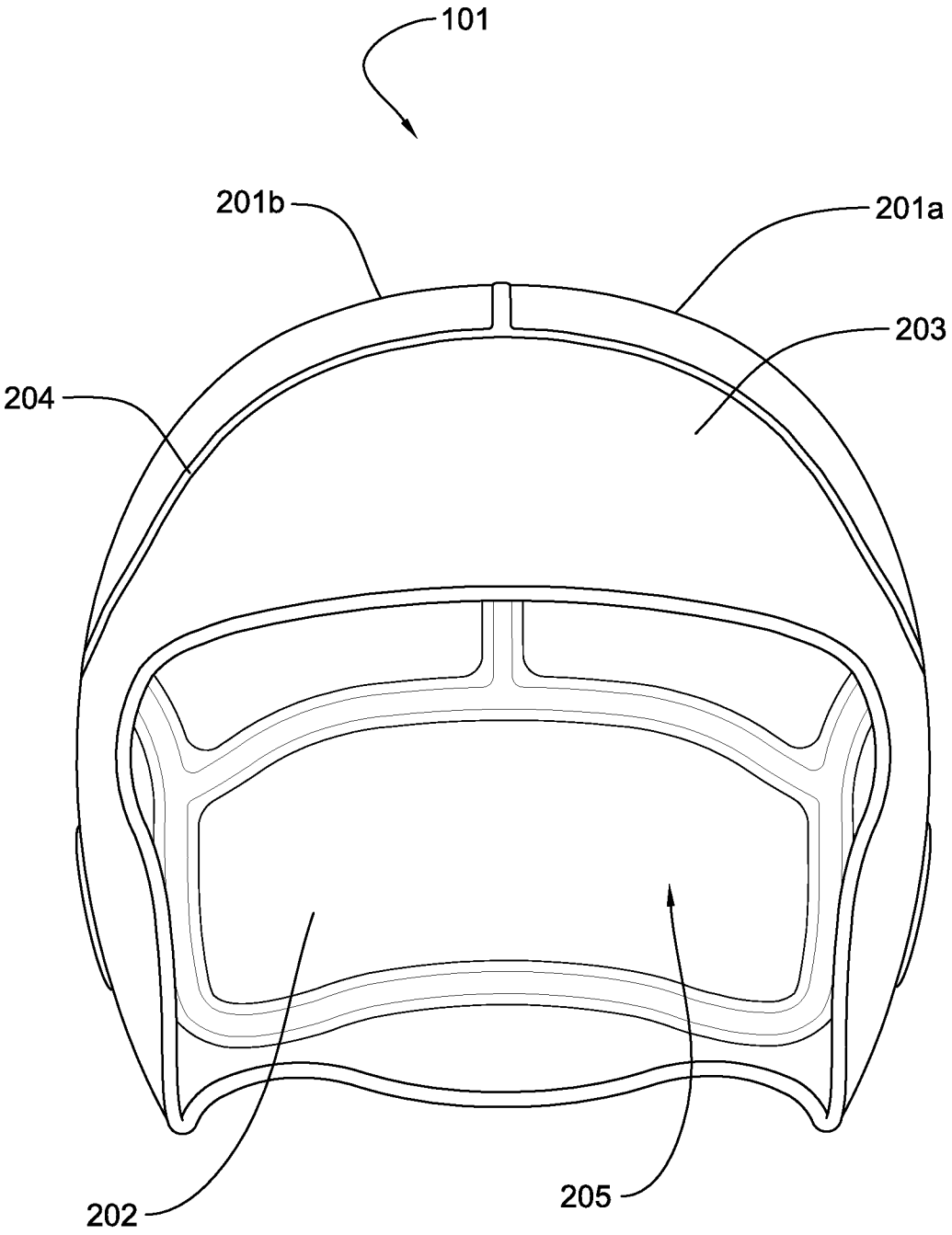
FIG. 2 is a front view of a helmet shell only.

FIG. 2 is a front view of shell 101 only, stripped of face guard 103, guard mounts 103*a* and 103*b*, and chin strap buckles 104*a* and 104*b* to provide a clearer illustration of the shell. Shell 101 may be made up of individual flexible, rigid or semi-rigid plates consisting of left plate 201*a*, right plate 201*b*, and lower plate 203 which encircles the head of the wearer. Back plate 202 can be seen from the inside through front opening 205. Shell 101 may be shaped to cover the head of the wearer with adequate clearance to include protective padding which does not show in this figure. Each plate has a convex outer surface and a concave inner surface and may be fabricated of molded polymer such as polycarbonate and other similar materials.

The plates are separated by a network of flexible molded elastomer seams or splines 204 that allow for movement of plates relative to adjacent plates, thus dissipating striking forces via flexibility between plates provided by the splines 204. Left plate 201*a* and corresponding right plate 201*b* may be shaped similar to and rest over the parietal bones of the cranium and back plate 202 may be shaped similarly to and rests over the occipital bone at the back of the cranium. Lower plate 203 may encircle the cranium across the frontal bone or forehead in the front and on each side across the areas of the zygomatic arch of the zygomatic bone or cheekbone and the temporal bones and ears. Plate 203 may continue around the back of the head across the area of the atlas or the highest vertebra of the neck.

Splines 204 completely surround the edges of all plates where they abut other plates. Lower plate 203 abuts plates 201*a*, 201*b* and 202 along its upper perimeter edge. The lower perimeter edge of plate 203 is open around open area 206 allowing for the vision of the wearer and around the jawline on each side and across the back of the neck. This lower edge does not abut to any other plates and does not fit up to any portion of spline network 204.

Figure 3A:
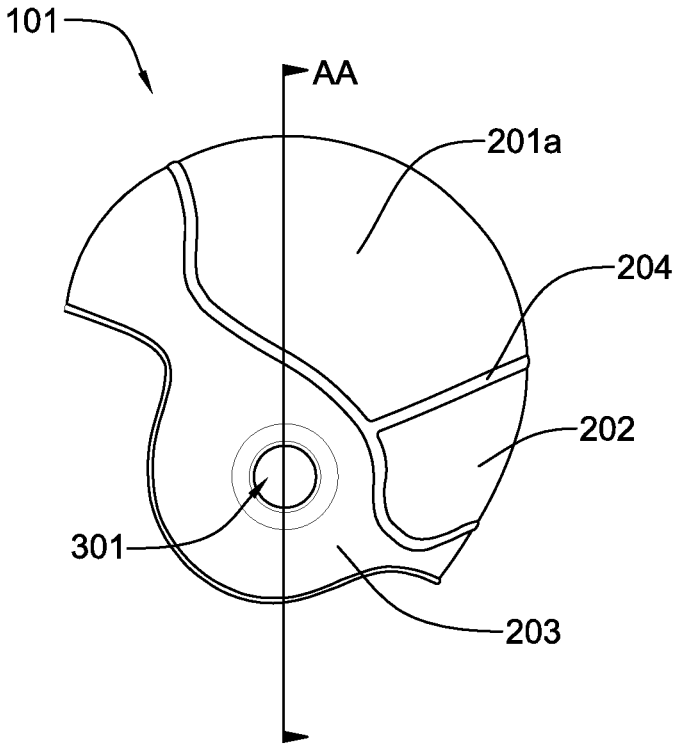
FIG. 3A is a side view of a helmet assembly.
Figure 3B:
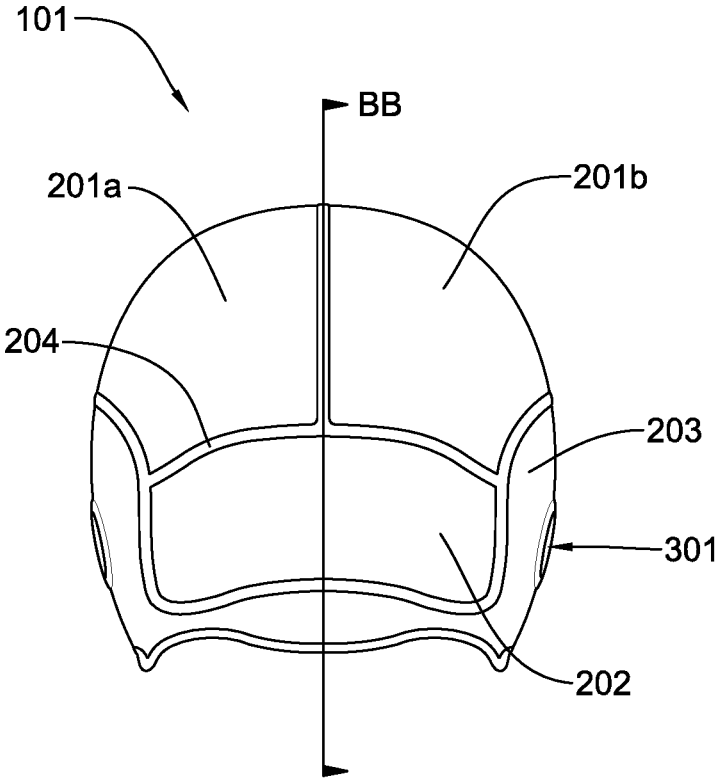
FIG. 3B is a back view of a helmet assembly.

FIG. 3A provides a side view of shell assembly 101. Plate 203 may be manufactured with circular openings 301 over the ear to allow sound to reach the wearer's ear. FIG. 3B shows a back view of assembly 101 which further illustrates the extent of the plates and shows their relation to splines 204. FIGS. 3A and 3B also have cross section cut lines AA and BB indicating a cross section views of FIGS. 6A and 6B respectively.

Figure 4:
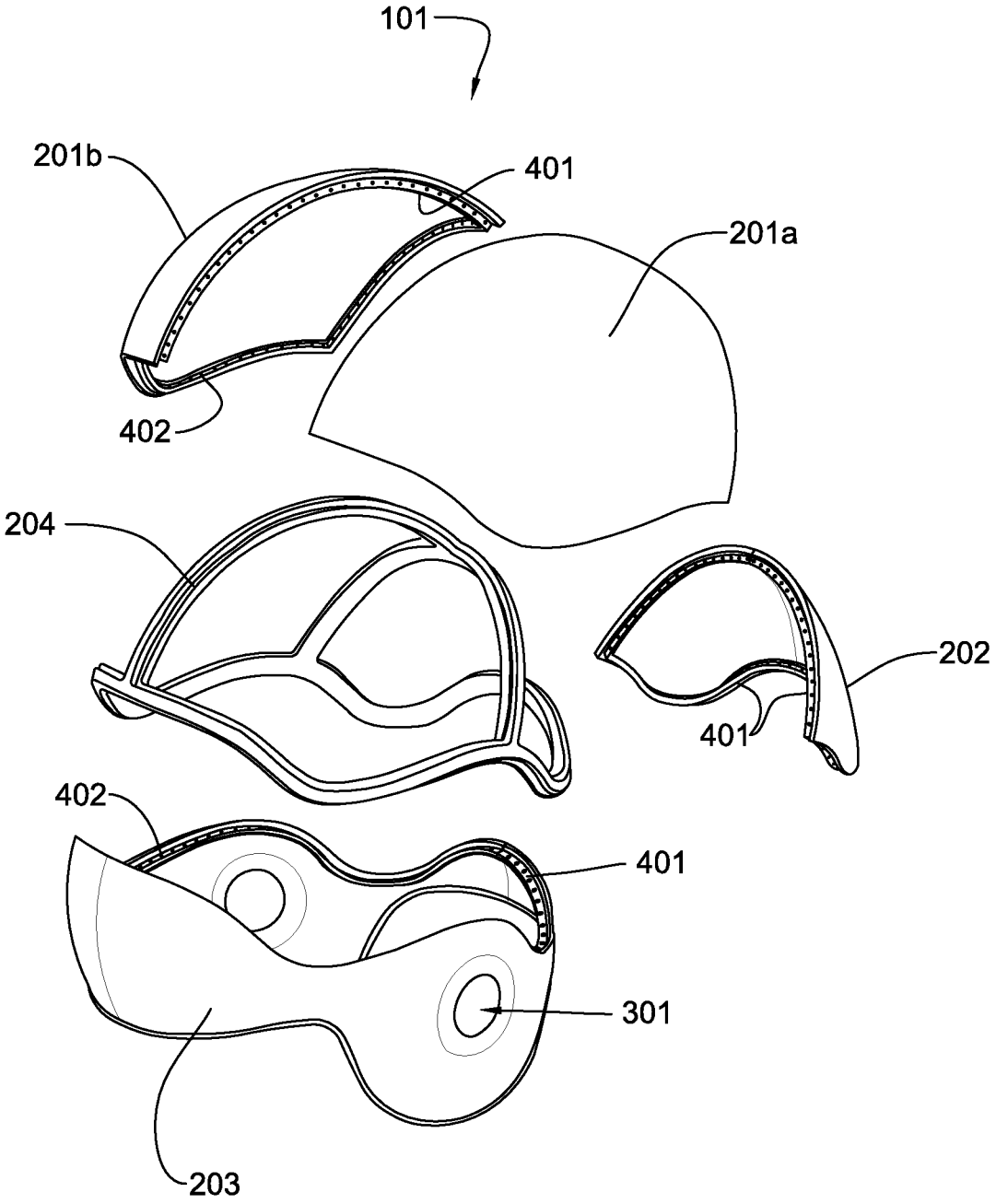
FIG. 4 is an exploded view of a helmet assembly.

FIG. 4 provides an exploded view of shell assembly 101. Plates 201*b* and 202 may be manufactured with integral suture flanges 401 along all perimeter edges. Plate 201*a* also includes flanges 401 along all under edges of the perimeter of the plate although not shown in this view. Lower plate 203 is manufactured with flange 401 only along the upper perimeter of the plate. As mentioned previously, the lower perimeter edge of plate 203 provides the opening through which the user dons the helmet. This lower edge does not abut any other plates and no flanges 401 are included along this edge. Suture holes 402 are drilled in equidistant spaced arrays along flanges 401. Holes 402 are drilled in flanges so that they align from one plate to opposing suture holes aligned in a flange 401 on an adjacent plate. For example holes 402 formed in flange 401 along the top edge of plate 201*a* align with the holes in flange 401 of plate 201*b* where both plates meet spline 204. Holes in flange 401 along the top edge of back plate 202 align with holes 402 along the bottom edges of adjacent plates 201*a* and 201*b* and so forth. FIG. 4 shows spline 204 as if it were a premade object or if shell 101 was taken apart after manufacture, as an aid in understanding each individual part of the helmet shell 101.

Figure 5A:
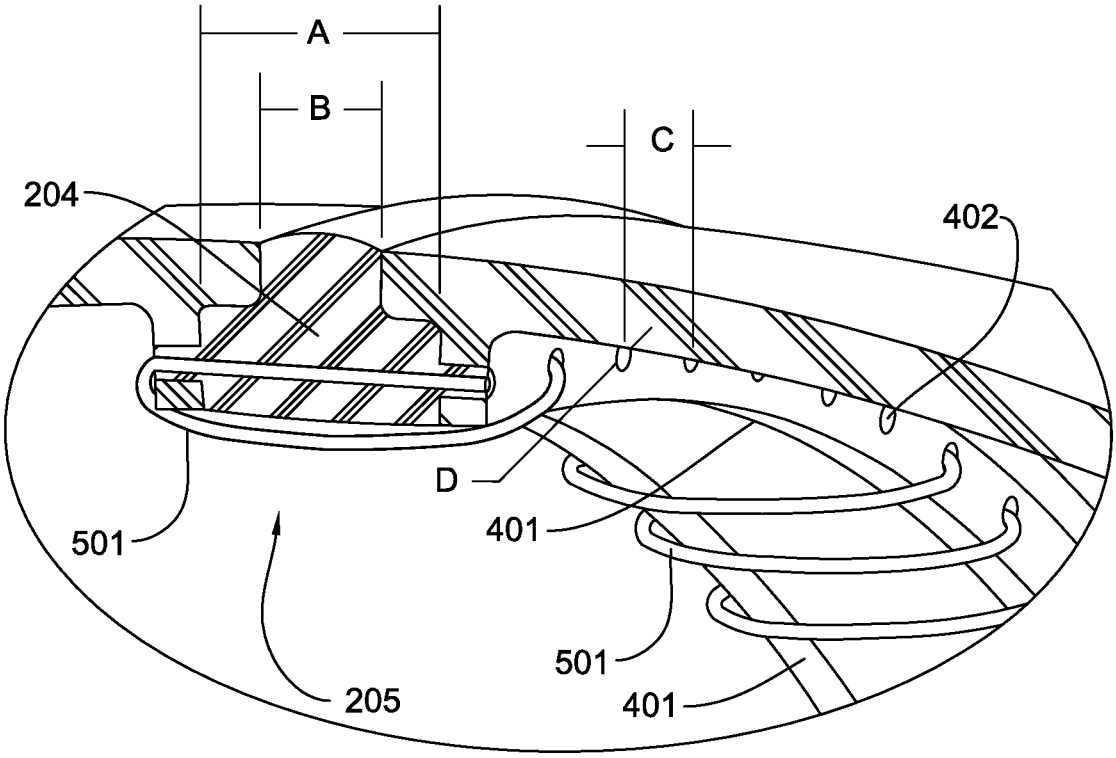
FIG. 5A provides a detail of the suture flange, sutures and elastomer embedment.

FIG. 5A shows an enlarged detail view of any two adjacent plate sections. This view shows a cross section of elastomer spline 204 between two flanges 401. High strength sutures 501 are threaded through suture holes 402 in flange 401, elastomer spline 204, and then through the meeting flange 401. Suture 402 then passes back across flanges 401 and spline 204 and into the next, adjacent suture hole. Sutures for this embodiment may be "energy dissipating stress fibers" (EDSF). One example of EDSF material is KEVLAR® aramid fiber which is an aromatic polyamide manufactured by DUPONT™. KEVLAR® was chosen for its capacity to reduce fatigue failure, the availability in various size threads, and the material's overall strength. It has the advantages of a combination of high strength, toughness and thermal stability, and many types are produced to suit a broad range of manufacturing uses. In this embodiment, stress fibers may be used in sutures 501 to couple the plates and to pre-load elastomer spline 204 thus allowing for enhanced reduction of rotational forces.

The purpose of the EDSF is to redirect secondary forces once reduced, and move them across and connect to spline 204 which connect to adjacent moveable plates to further dissipate forces entering the helmet assembly and restrict forces from entering the skull and cervical spine of the wearer, reducing the potential for concussive injury. It is known in the art that transmission of forces from the skull to the cervical spine via supporting tendons, ligaments, muscles, joint/capsules and back to the brain via reciprocal tension membranes which are the coverings of the spinal cord, especially the Dura Mater, can be reduced during an impact event by limiting rotational forces at the point of contact. In another embodiment after the sutures are secured between plates. an elastomer material is injection molded over the sutures which cures and forms the spline 204.

As shown in FIG. 5A, flanges 401 of this embodiment may be approximately ⅛" to ¼" wide and protrude to the interior of shell 101 approximately ¼" inch or more. These dimensions may vary in other embodiments of the invention, as long as the flanges are formed to host suture holes 402 in a manner enabling the holes to securely hold the EDFS securely even in high stress situations including rotational and direct impact forces. The orientation of the EDSF is unique. The KEVLAR® sutures 501 are interlaced between two cranial plates or one or more cranial plates and back plate 202 or lower plate 203 and may serve to preload the elastomer spline 204. When the fibers are aligned in this orientation, it allows for these fibers to respond differently depending on the force and direction of force introduced into the wearer. In human anatomy, ligaments and tendons are uniaxial in their capacity to transmit force meaning they move force in one direction. Throughout the cervical spine, there are multiple uniaxial structures directing force to the spine and away from the spine towards the calvarum. The helmet system of this invention is designed to, and has the capacity to adapt to forces in much the same manner as tendons, ligaments and muscles, reducing force to the skull and translational structures in the cervical spine, and ultimately reducing perceived force in the brain and neural tissue.

As seen in FIG. 5A, suture holes 401 in this embodiment have a spacing dimension C of 0.5 cm to 10 cm and a diameter of dimension D of 0.10 cm to 2.5 cm. Dimension B represents the width of elastomer spline 204 visible on the outside of shell 101 and the designed spacing between adjacent plate edges. Dimension A indicates the overall width of spline 204 inside the helmet, which is much wider than Dimension B, as much as twice the dimension of B in some embodiments.

Suture flanges 401 may be set back from the perimeter edge of plates to allow widened Dimension E of spline 204 which provides additional strength and stability. In assembly of the shell 101 the plate sections are placed in a mold of the final helmet 100 outer shape and dimensions. The plates are secured in the mold such that the spacing between plates equal dimension A. Sutures 501 are laced through matching suture holes 402 and tightened to the desired tension and secured. An amount of tightening of the sutures may be selected depending upon the type of activity and forces the helmet will be subjected to. An elastomer material of desired pliability and resiliency may be injected or over-molded into voids created by the flanges 401 and secured sutures 501, The material then cures to form spline 204 with pre-laced sutures 501 embedded therein. A durometer of the elastomer material enables shock resistance between plates, thereby distributing forces the helmet is subjected to. Additionally, the underlying sutures enable added structure and resilience between plates and work together to absorb and distribute forces to plates of the helmet.

Widths A and B of elastomer spline 204, spacing C and diameter D of holes 304, and diameter and type of sutures may vary to maintain the desired suture geometry in other embodiments of the invention to withstand and react to the types of forces incurred in other sports or activities. In other embodiments of this invention, the network of splines 204 may be injection molded as a separate entity and sutures 501 stitched through holes 402 in flanges 401 and through the premolded spline. FIG. 4 represents how premolded spline 204 would be shaped.

Figure 5B:
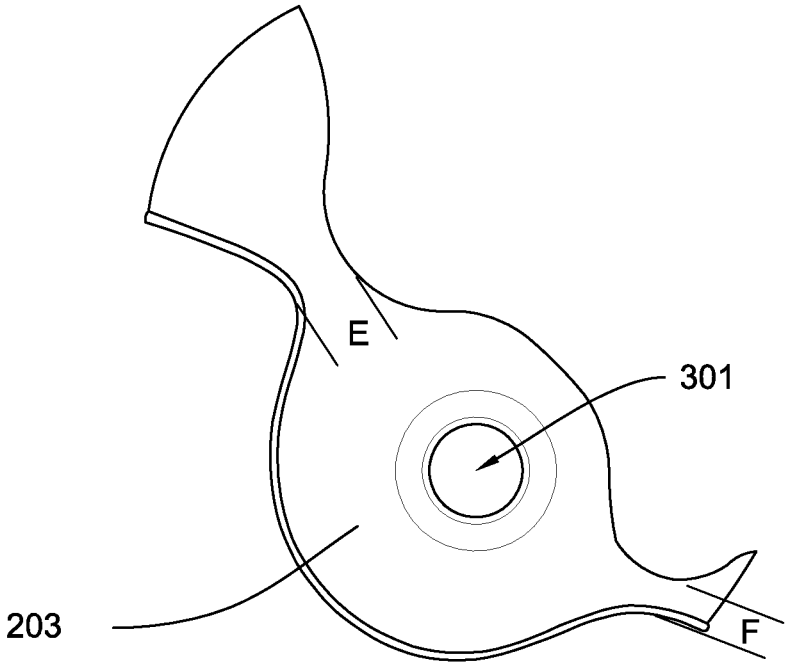
FIG. 5B is a side perspective view of the geometry of lower plate.

FIG. 5B shows a perspective view of lower plate 203. Width E at the temple and width F behind ear opening 301 are minimized to enhance the capacity of the plate to flex at these locations when a forceful blow is applied thus helping to dissipate the force.

Figure 6A:
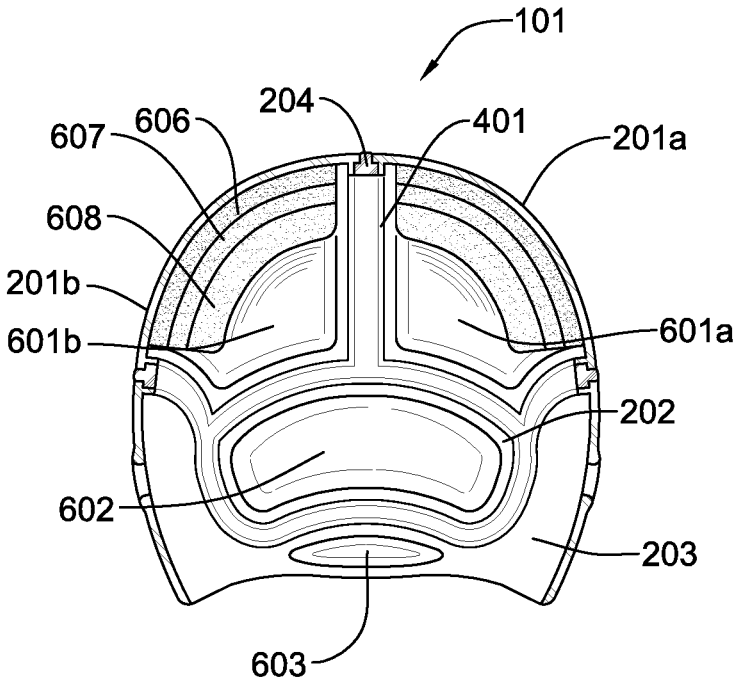
FIG. 6A is a side-to-side section view of helmet with cushions.
Figure 6B:
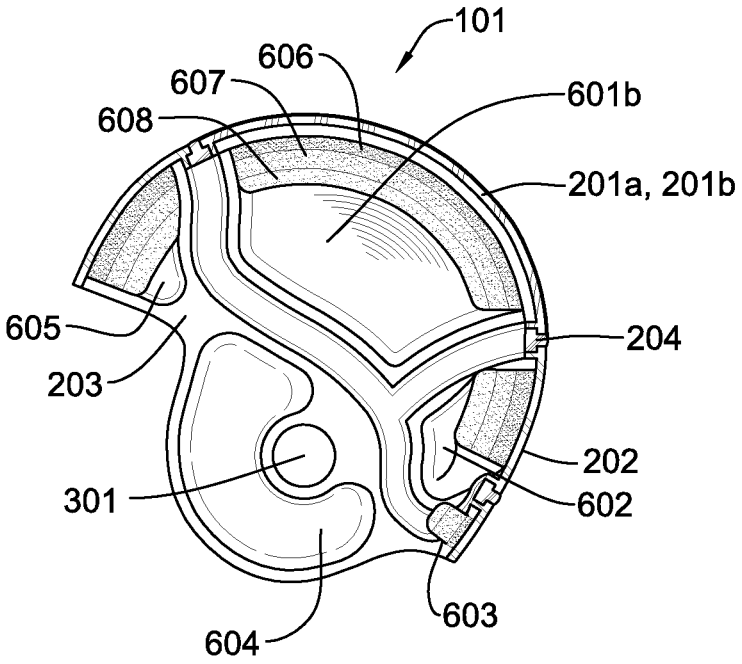
FIG. 6B is a front-to-back section view of helmet with cushions.

FIG. 6A provides a front view of a cross section of shell 101 cut laterally along line AA of FIG. 3A. Left cushion 601*a* and right cushion 601*b* may be manufactured to completely cover the inside surfaces of plates 201*a* and 201*b* nesting inside flanges 401. Likewise back cushion 602 is sized to cover an inside surface of back plate 202. Neck cushion 603, jaw cushion 604, and front cushion 605 may be assembled to cover specific areas of lower plate 203 and affixed to an inside surface of the plate as seen in FIG. 6B.

Cushions are fabricated with one or more layers of foam of differing durometers, preferably three layers of foam, each layer having different characteristics. Outer layer 606 may be constructed of open cell urethane, a material such as PORON® XRD which is breathable, easily customized, and may be incorporated into a variety of designs. High speed impact tests show that the soft contouring material instantly dissipates force upon impact absorbing up to 90% of energy at high speed impact as measured according to ASTM-F1614-C. This material gets its softness when at rest while above the "glass transition temperature" (Tg) of the urethane molecules. When stressed at a high rate or impacted quickly, the Tg of the material reaches a point when the urethane momentarily firms to form a comfortable protective shell that shields the body from impact better than other protective foams currently available.

Middle layer 607 may be of dense open or closed cell foam having more "give" or having a lesser durometer than the outer layer, such as INDUSTRIAL POLYMERS CORPORATION™ FX Flex Foam 1000® and the innermost or comfort layer 608 may be constructed of softer foam having a durometer rating less than the middle layer, such as FX Flex Foam 600. FX Flex® foams are available in densities ranging from 6 lbs. to 26 lbs. per cubic foot. These materials are elastomeric polyurethane that when fully cured form a tough abrasion resistant rubber foam product with an integral rubber skin with excellent cosmetic finish requiring almost no further processing. Other embodiments may make use of other materials for example, slow recovery neoprene, polyethylene, polystyrene and other like materials.

The layers of the multi-density cushions react differently to applied force; their relative densities offer differing capacities to absorb loads. As force is applied to a layer it begins to deform plastically under the load, absorbing the crushing force until it reaches a point where it is no longer absorbing force. The remaining reduced force is then transferred to the next layer which in turn begins to deform under the load as it absorbs force until it is no longer able to deform further. The differing densities allow the layers to shear and to deal with rotational force much more effectively.

The foam layers will be adhered together and to the convex inner surfaces of the plates with a flexible adhesive, allowing the foam to behave anisotropically, becoming a multi-directional force absorbing cushion. The adhesives used will be chosen based on flexibility and strength as well as their compatibility with the chemical and molecular structure of the foam.

FIG. 6B depicts front-to-back section view of helmet with cushions cut along line BB of FIG. 3B. Right cushion 601*b* is seen in this view along with the cushions and foam layers as introduced in FIG. 6A. The elastomer spline 204 as shown in FIGS. 6A and 6B enable segmented construction of cushions which results in elastic material between cushions which allows for movement of cushions in relation to each other further dissipating forces transferred from the cushions to the head and neck.

Figure 7:
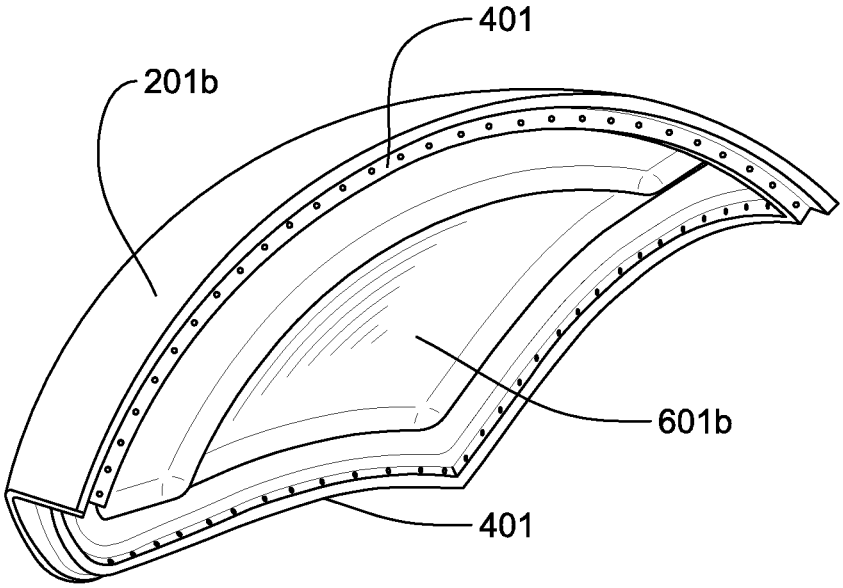
FIG. 7 provides a detail view of a cushion adhered to a plate.

FIG. 7 is an enlarged view of plate 201*b* and corresponding cushion 601*b* providing a clearer view of suture flanges 401 in relation to plate and cushions. All plates of the invention are formed in a same fashion. In this view the cushion 601*b* completely covers the inner surface nested within flange 401. All of the cushions in the helmet system of 101 are oriented and affixed in a similar or same manner, within their specific shapes matched to an adjoining plate 201*a*-203.

Another embodiment may include that the sutures span across an entire undersurface of the plate before engaging perforations in flanges on an adjacent plate. In this manner force distribution may be maximized and contained from plate to plate. In this embodiment the sutures may be between a first layer of foam and an undersurface of the plate, or alternatively embedded in the first layer of foam.

Figure 8A:
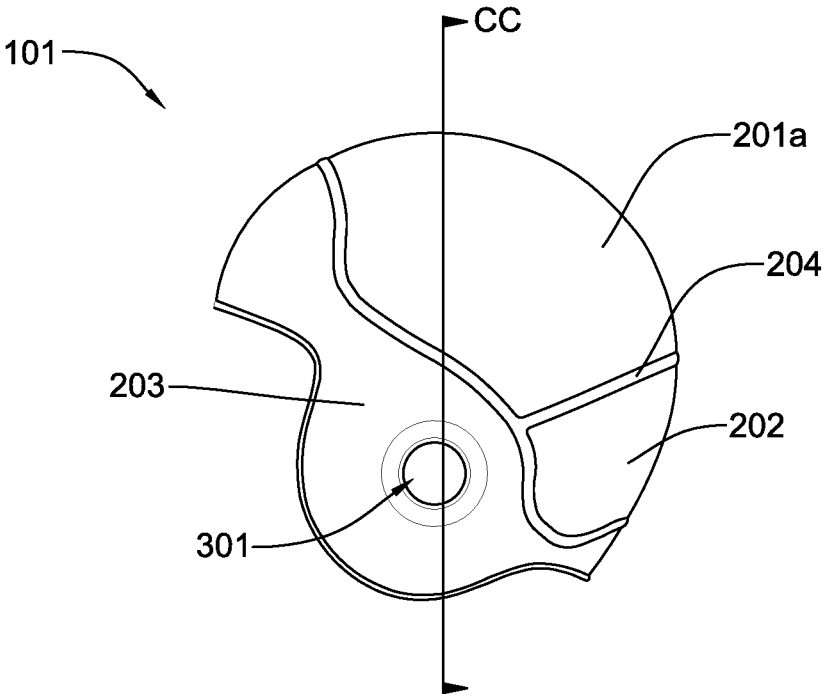
FIG. 8A shows a side view of a helmet show in another embodiment.
Figure 8B:
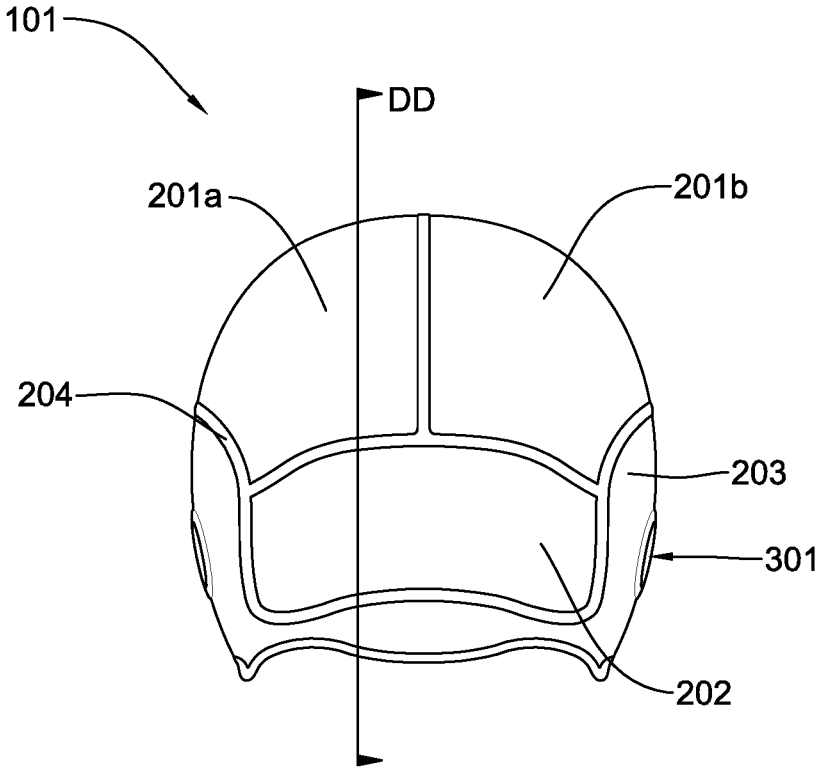
FIG. 8B shows a rear view of the helmet of FIG. 8A.

FIG. 8A is a side view of a helmet having shell 101 in another embodiment wherein the cushions form a single integral removable insert. FIG. 8A shows the elastomer spline extending through shell plates 201*a*, 202, and 203. Another embodiment provides a single solid plate covering the internal cushion (not shown). The single plate may also be fabricated of molded polymer such as polycarbonate and other similar materials. FIG. 8B is a rear view of the helmet shell 101 of the helmet having the removable cushion insert.

Figure 9A:
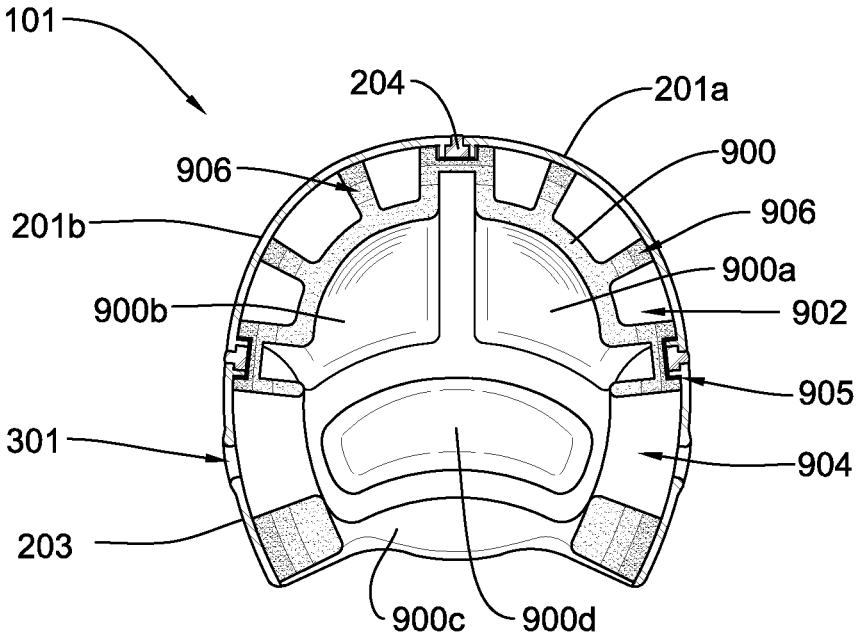
FIG. 9A is a front section view of an alternate cushion arrangement.
Figure 9B:
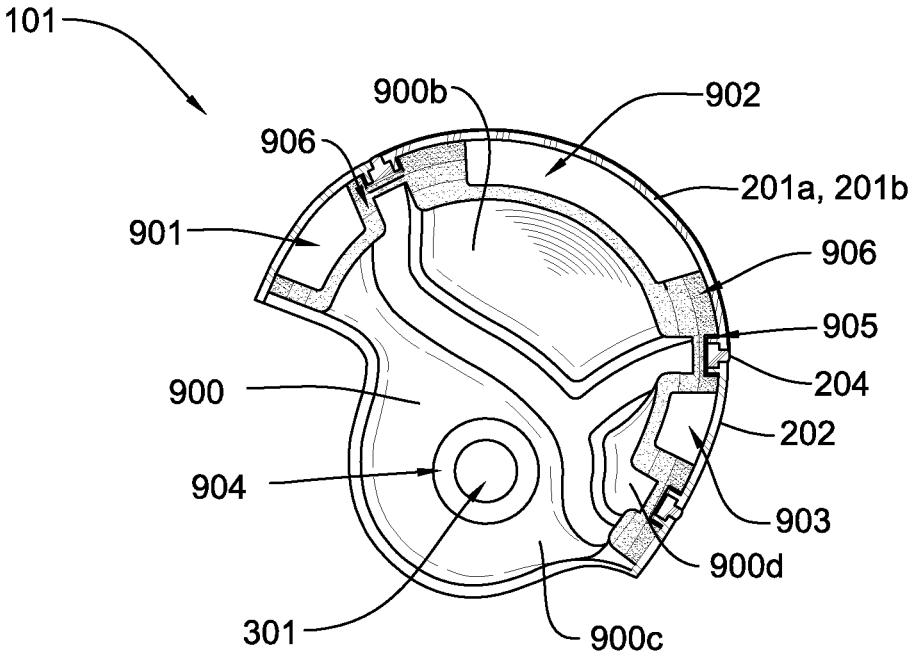
FIG. 9B is a side section view of the alternate cushion arrangement of FIG. 9A.

FIG. 9A shows a front section view cut along line CC of FIG. 8A. This view shows a plurality of cavities 901-902 formed in cushion insert 900 holding a volume of air. Cavities 901, 902 are hermetically sealed to hold air in the cavities via air tight seal with via cavity walls 906 which surround each cavity and one or more adjacent plates 201*a*, 201*b*, 202 and 203. The foam surrounding the cavities may be glued with various adhesives or heat sealed to an adjacent shell plate. The cavities 901-903 actually serve as a series of hermetically sealed chambers, wherein during an impact, the air trapped within the cavities is displaced and deform the surrounding cushion material under a load of the impact, further dissipating the force prior to reaching a wearers head. In an alternative embodiment the cavities 901-903 are formed completely within the cushion material and not via a seal with an adjacent plate. Ear hole 301 may be formed within ear opening 904. Further, with a seal formed around the ear hole 301, ear opening 904 could also form an additional cavity. FIG. 9B is a side section view of the alternate cushion arrangement of FIG. 9A cut along line DD showing the elements introduced in FIG. 9A.

Figure 10A:
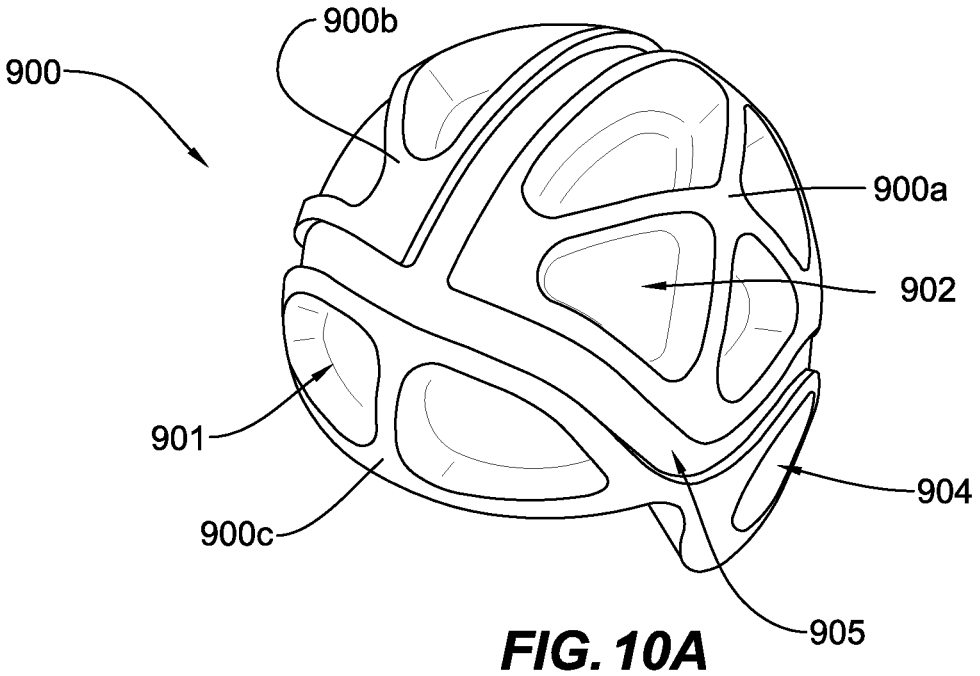
FIG. 10A is a front top view of a cushion insert.
Figure 10B:
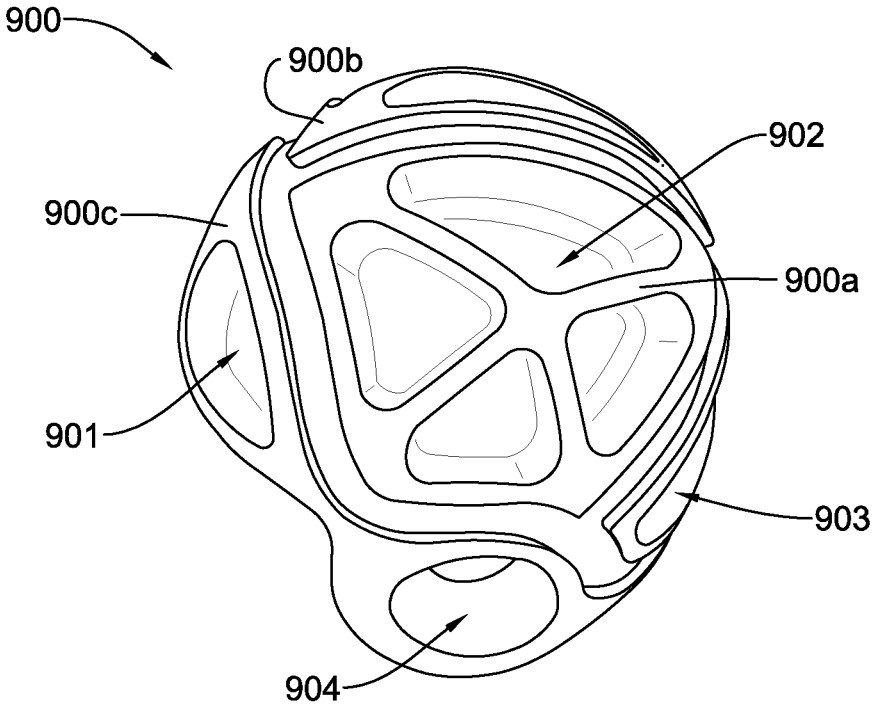
FIG. 10B shows a side elevation view of the cushion insert.

FIG. 10A shows front top view of a removable cushion insert 900 without the shell or shell plates in order to view the structure of the insert, itself. Separating grooves 905 separate cushion pads 900*a*, 900*b*, 900*c* and 900*d* (not shown). Said cushion pads correspond in shape to the plate sections they are positioned adjacent to when the helmet is fully assembled. Grooves 905 may align and match with spline 204. The grooves 905 have a diameter of approximately 0.125" to 0.25" providing more cavity space between the cushion pads 900*a*-900*c* thereby assisting in dampening an impact to the helmet. The cavities 901-903 also serve to further dissipate force of an impact and dampen the impact force thereby protecting the head and neck of the wearer. The inventor has discovered that by disrupting a constant foam (tiny air cavities) material with the air cavities 901-903 and grooves 905, force of an impact may be halted or significantly dissipated when the force vibration meets a cavity and/or groove. FIG. 10B is side top view of cushion insert 900 having same element numbers as FIG. 10A.

Figure 11:
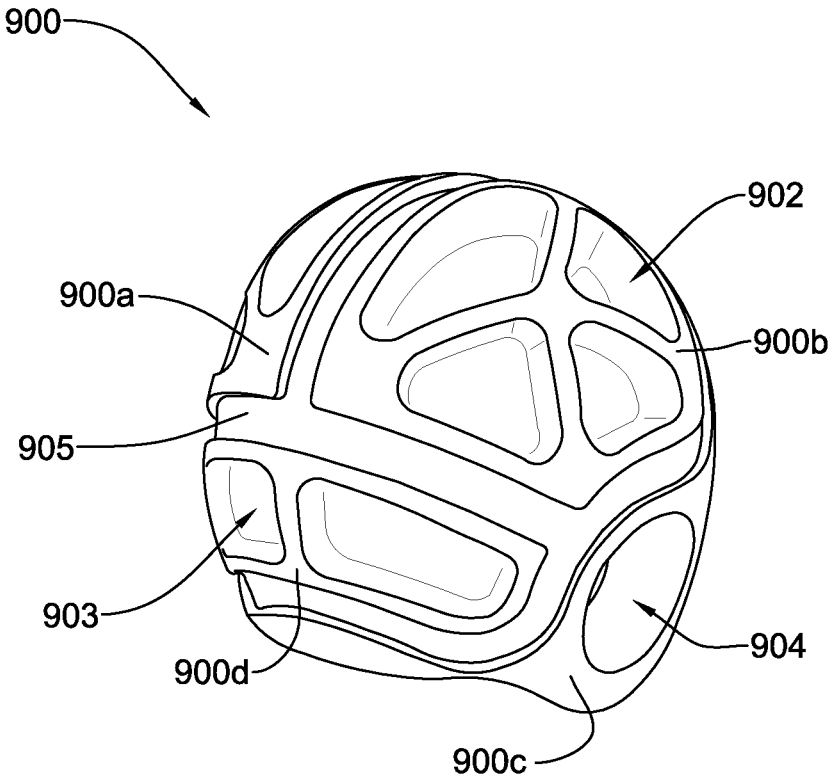
FIG. 11 is a rear view of the cushion insert.

In this embodiment the cushion insert may be custom sized to a wearer, wherein a flexible mold may be fit onto a wearers head, the cushion insert may be fabricated to a custom fit of the wearer and cushion inserts may be removed from helmet shells 101 and replaced so helmet shells or shell plates and splines may be reused between wearers while the cushion insert is a custom fit. In this embodiment the cushion insert may be adhered to the helmet shell via a flexible adhesive, velcro or any other means of removably securing the cushion insert within a helmet shell. FIG. 11 is a rear view of the cushion insert 900 showing all of the elements introduced in FIGS. 10A and 10B. An additional cushion pad 900*d* is shown corresponding to an area of the cushion being adjacent to lower plate 203. An overall thickness of the helmet in any of the embodiments described, herein, ranges from 2"-5".

One embodiment includes a single polymer shell formed to completely cover the cushion insert 900 or all of the cushions 601*a*-605. Numerous modifications and adaptations of the pressure attenuating helmet of the invention will readily be apparent to those skilled in the art. Thus it is intended by the appended claims to cover all such modifications and adaptations as fall within the true spirit and scope of the appended claims.

The invention claimed is:

1. A pressure attenuating helmet comprising; a plurality of separate plates each plate having a plate thickness, an outer surface, under surface, and edges adjacent to other edges of the plurality of plates, the plates joined along the adjacent edges thereby forming a helmet shell;

flanges formed along the under surface at the adjacent edges of the plurality of separate plates, the flanges formed inwardly along a line spaced at a first dimension from the adjacent edges of each of the plates, the flanges extending in a direction of the thickness of the plates;

a network of elastomer splines shaped and positioned to separate the plates both along the edges and the flanges; and a first foam layer is formed to the undersurface of each plate and at least a second foam layer is formed to a surface of the first foam layer facing away from the plates;

wherein foam material of the first foam layer includes a durometer rating, the second layer having a durometer rating less than the durometer rating of the first foam layer.

2. The helmet of claim 1, wherein the plurality of plates are shaped and oriented in the helmet to at least one or more of the parietal bones of the human cranium, occipital bone, frontal bone, zygomatic arch, temporal bones and atlas vertebra of the neck when actually worn by a user.

3. The helmet of claim 1, wherein a third foam layer is formed on a surface of the second foam layer facing away from the first foam layer, the third foam layer enabled to engage a user's head and including a durometer rating less than the durometer rating of the second foam layer.

4. The helmet of claim 3, wherein cavities are formed in the foam layers, edges of the cavities hermetically sealed to the plates to form cavities with a volume of air.

5. The helmet of claim 3, wherein the foam layers are adhered to each forming a single foam insert and the foam insert is removably attached to the plates.

* * * * *